US007577265B2

(12) United States Patent
Pazandeh

(10) Patent No.: US 7,577,265 B2
(45) Date of Patent: Aug. 18, 2009

(54) LOUDSPEAKER SYSTEM PROVIDING IMPROVED SOUND PRESENCE AND FREQUENCY RESPONSE IN MID AND HIGH FREQUENCY RANGES

(76) Inventor: Ira Pazandeh, 18700 Yorba Linda Blvd #56, Yorba Linda, CA (US) 92886

( * ) Notice: Subject to any disclaimer, the term of this patent is extended or adjusted under 35 U.S.C. 154(b) by 889 days.

(21) Appl. No.: 10/966,982

(22) Filed: Oct. 15, 2004

(65) Prior Publication Data

US 2005/0286730 A1 Dec. 29, 2005

Related U.S. Application Data

(60) Provisional application No. 60/583,495, filed on Jun. 29, 2004.

(51) Int. Cl.
*H04R 25/00* (2006.01)

(52) U.S. Cl. ..... 381/160; 381/300; 381/303; 381/304; 381/182; 381/386; 181/199; 181/144; 181/145; 181/147

(58) Field of Classification Search ..... 381/182, 381/351, 337, 150, 300, 342, 152, 160, 303, 381/304, 186, 386; 181/144, 147, 145, 154, 181/185, 189, 199
See application file for complete search history.

(56) References Cited

U.S. PATENT DOCUMENTS 3,759,345 A 9/1973 Borisenko
4,107,461 A 8/1978 Bose
4,179,008 A 12/1979 LeTourneau
4,391,346 A * 7/1983 Murakami et al. ..... 181/147
4,437,540 A * 3/1984 Murakami et al. ..... 181/147
4,923,031 A 5/1990 Carlson
5,268,538 A * 12/1993 Queen ..... 181/144
5,388,162 A 2/1995 Sohn
5,590,214 A 12/1996 Nakamura
5,781,645 A 7/1998 Beale
5,857,027 A 1/1999 Gaidarov et al.
6,068,080 A 5/2000 LaCarrubba
6,118,883 A 9/2000 Rocha
6,134,332 A * 10/2000 Wiener ..... 381/160
6,603,862 B1 * 8/2003 Betts ..... 381/336
7,046,816 B2 * 5/2006 Vandersteen ..... 381/182
2001/0031061 A1 * 10/2001 Coombs et al. ..... 381/349
2004/0086144 A1 * 5/2004 Kallen ..... 381/404
2004/0131217 A1 7/2004 Opie et al.

* cited by examiner

*Primary Examiner*—Vivian Chin
*Assistant Examiner*—Fatimat O Olaniran

(57) ABSTRACT

A speaker system includes a first, second and third sound radiators with the second sound radiator positioned medially between the first and third sound radiators. The radiators project first, second and third sound vectors respectively, with the second sound vector oriented vertically and the first and third sound vectors directed generally toward each other at angles above the horizontal so as to intersect at an inclusive angle between 90 and 170 degrees. Sound from the first and third radiators impinges on the second radiator so as to cause an echo effect improving sound spaciousness. The first and third radiators are placed at different angles relative to the listener and at different heights as well to improve time delays in the two radiated signals.

4 Claims, 3 Drawing Sheets

LOUDSPEAKER SYSTEM PROVIDING IMPROVED SOUND PRESENCE AND FREQUENCY RESPONSE IN MID AND HIGH FREQUENCY RANGES

RELATED APPLICATION

This application claims the priority date of a prior filed, and now pending, provisional patent application having Ser. No. 60/583495 and official filing date of Jun. 29, 2004.

BACKGROUND OF THE INVENTION

1. Field of the Invention

This invention relates generally to loudspeaker systems, and more particularly to a loudspeaker system using plural sound radiators in a specific arrangement resulting in a wider dispersion of sound over the full range of audio frequencies.

2. Description of Related Art

The following art defines the present state of this field and each disclosure is hereby incorporated herein by reference:

Borisenko, U.S. Pat. No. 3,759,345, describes a stereophonic sound-reproducing system comprising two sound-reproducing sets separated by a base distance and each having a high-frequency section and a mid frequency section. The mid frequency section is provided with an acoustic focuser, the acoustic axis of which is so oriented towards the base line as to make the perception of the spatial sound panorama practically independent of the listener's position on a line parallel to the base line.

LeTourneau, U.S. Pat. No. 4,179,008, describes a loudspeaker assemblage that is made up of a group of cylindrical speaker housings, with a speaker mounted in each housing. A respective spacer in the form of a wedge block or angle sleeve is interposed between adjacent housings, so that housing end closures abut respective wedges. A flexible tension member passes through each speaker housing and spacer so that when the tension member is taut, the housings and spacers are clamped to make up a relatively rigid structure having a generally toroidal shape. The tension member is releasable so that the speaker housings can be rotated about a respective axis normal to the speaker axis to selectively orient the speakers. When the tension member is taut, the speakers are retained in the selected orientation.

Carlson, U.S. Pat. No. 4,923,031, describes a loudspeaker with a pair of speaker units and a manifold chamber between the speaker units for combining the sound from both speaker units. The manifold chamber is formed by walls having an exit opening and a pair of rectangular apertures, the apertures confronting each other on opposite sides of the chamber and the exit opening being disposed normal to a plane centrally between the apertures, and the apertures and exit opening having parallel axes of elongation. One of the speaker units is coupled to each of the apertures to direct sound into the manifold chamber, and the manifold chamber is provided with a wedge confronting the apertures to direct sound parallel to the central plane between the apertures toward the exit opening. In one construction, a horn is coupled to the exit opening to conduct sound from the manifold chamber. Also in that construction, each of the speaker units has a vibratile cone confronting the apertures to which it is coupled and the cone is disposed in an enclosure provided with a bass reflex port. In another construction, four speaker units with vibratile cones are coupled to four apertures in walls forming a single manifold chamber with a single exit opening. In still another construction, a compression driver is coupled to each of the apertures through a transition section of the driver.

Sohn, U.S. Pat. No. 5,388,162, describes a speaker system designed to use wider resonant sound waves by two conventional speakers which are symmetrically and oppositely disposed to face one another along a co-axis on which both axes of the cone paper vibrator of the speakers are aligned. A sponge like sound wave absorbing material with cone-shaped recesses may be disposed in between the speaker and spherical speaker case.

Beale, U.S. Pat. No. 5,781,645, describes a loudspeaker system that comprises an array of cells each including a loudspeaker driver unit. The axes of all the driver units converge at a single point in front of the array, such point normally lying between the array and the listeners. An arrangement is described for steering the sound from the system by varying the relative level of the audio frequency signals applied to the driver units.

Gaidarov et al., U.S. Pat. No. 5,857,027, describes a loudspeaker that particularly comprises two-aperture radiator containing paired in-phase counter-radiating apertures and reproducing middle frequencies. Apertures face each other, and their geometrical axis F is positioned vertically, while the distance between apertures equals to at least the radius of aperture but does not exceed the wavelength of the lowest frequency reproduced by paired apertures.

Nakamura, U.S. Pat. No. 5,590,214, describes the efficiency of a vertical array speaker device that is raised to obtain an adequate level of sound and to confine the horizontal radiation of the listening area of a surround sound system. A pair of baffle boards are mounted to a vertical array with small diameter speakers, in symmetrical opposition, the boards are attached together at their rear edges while the front edges are held open a predetermined width.

LaCarrubba, U.S. Pat. No. 6,068,080, describes an apparatus for the redistribution of acoustic energy which comprises a lens having a reflective surface defined by the surface of revolution R1 of an elliptical arc A1 rotated about a line L through an angle .alpha.1 and the surface of revolution R2 of an elliptical arc A2 rotated about the line L through an angle .alpha.2. Each elliptical arc A1 and A2 constitutes a portion of an ellipse E1 or E2 having a focal point located at a point F1 on line L, and shares an end point P which lies on the reflective surface and the line L. The angle .alpha.1 is chosen such that the surface of revolution R1 is convex with respect to an adjoining surface S1 and the angle .alpha.2 is chosen such that the surface of revolution R2 is concave with respect to the adjoining surface S1.

Rocha, U.S. Pat. No. 6,118,883, describes an improved loudspeaker system that increases low frequency directivity and minimizes directivity discontinuities during frequency transitions, includes a first low frequency transducer, a second low frequency transducer, a middle frequency transducer assembly, and a middle frequency horn assembly having a small input aperture and a large output aperture. The middle frequency transducer assembly is attached at the small aperture of the horn assembly and directs a middle frequency acoustical signal into the horn assembly. The low frequency transducers and are mounted to opposite interior surfaces, preferably the top and bottom surfaces, of the horn assembly, and direct a low frequency acoustical signal into the horn assembly. A composite acoustical signal directed out of the horn assembly from the large aperture. The distance D.sub.1, measured from the upper transducer voice coil to the lower transducer voice coil, is substantially equal to 0.9048 of the distance D.sub.2, measured from the bottom edge of the output aperture to the top edge of the output aperture. Such a relationship between D1 and D2 results in a smooth transition and a substantially continuous acoustical beam width in the composite acoustic signal within low frequency to middle frequency crossover band.

Our prior art search with abstracts described above teaches: specific loudspeaker system layouts, an arbitrary coverage angle sound integrator, a vertical array type speaker system, a stereophonic sound reproducing system, a structure and arrangement for loudspeaker assemblage, an environment for demonstrating a stereo loudspeaker system, a high output loudspeaker system, a sound innovation speaker system, a system for controlling low frequency acoustical directivity patterns and minimizing directivity discontinuities during frequency transitions, and an apparatus for the redistribution of acoustic energy. Thus, the prior art shows, that it is known to arrange loudspeakers in a particular manner to achieve improvements in sound dispersion and uniformity of various frequency ranges. However, the prior art fails to teach opposing mid-range radiators set with differing positions relative to the listener and with their radiation impinging on a central tweeter radiator so as to improve sound quality through echo, delay, and muffling of spurious echo. The present invention fulfills these needs and provides further related advantages as described in the following summary.

SUMMARY OF THE INVENTION

The present invention teaches certain benefits in construction and use which give rise to the objectives described below.

In the best mode embodiment of the present invention, a speaker system includes a first, second and third sound radiators with the second sound radiator positioned medially between the first and third sound radiators. The radiators project first, second and third sound vectors respectively, with the second sound vector oriented vertically and the first and third sound vectors directed generally toward each other at angles above the horizontal so as to intersect at an inclusive angle a between about 90 and 170 degrees (see FIG. 3). Sound from the first and third radiators impinges on the second radiator so as to cause an echo effect improving sound presence, by which is meant the illusion of spaciousness to the listener. The first and third radiators are placed at different angles relative to the listener and at different heights as well to improve time delays in the two radiated signals.

A primary objective of the present invention is to provide an apparatus and method of use of such apparatus that yields advantages not taught by the prior art.

Another objective of the invention is to provide a sound system that has improved sound qualities without expensive hardware improvements.

A further objective of the invention is to accomplish such improvements by placement of mid-range sound radiators relative to a high range radiator.

A still further objective of the invention is to make such placements so as to use sound reflection and diffusion, as keys to improved sound spaciousness, depth of field, and improved dispersion.

Other features and advantages of the embodiments of the present invention will become apparent from the following more detailed description, taken in conjunction with the accompanying drawings, which illustrate, by way of example, the principles of at least one of the possible embodiments of the invention.

BRIEF DESCRIPTION OF THE DRAWINGS

The accompanying drawings illustrate at least one of the best mode embodiments of the present invention. In such drawings.

DETAILED DESCRIPTION OF THE INVENTION

The above described drawing figures illustrate the present invention in at least one of its preferred, best mode embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

Figure 1:
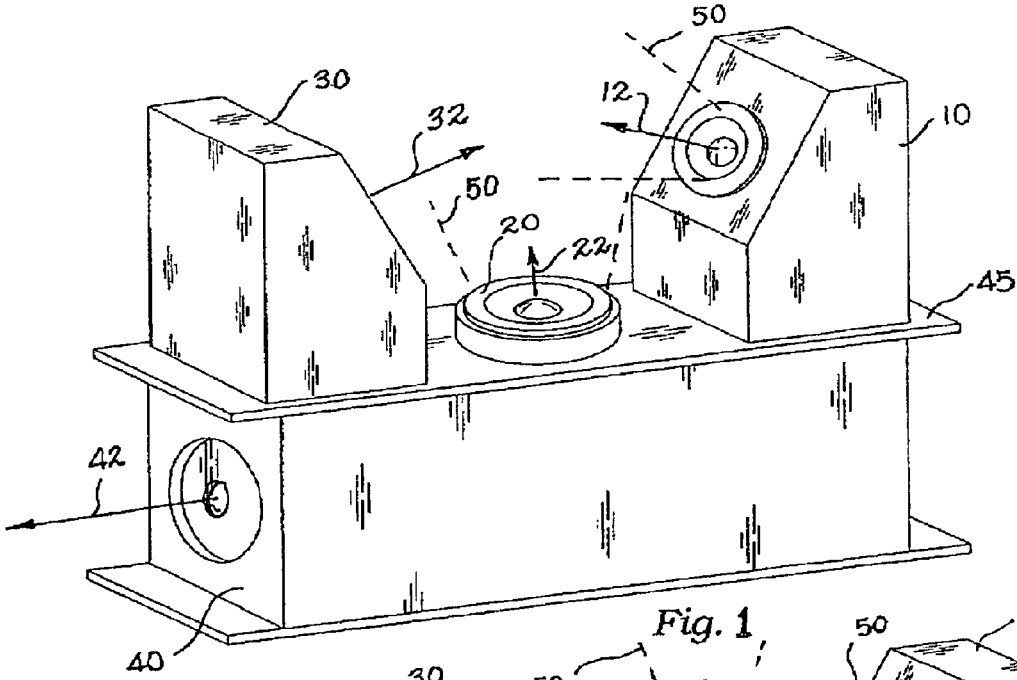
FIG. 1 is a perspective view of a preferred embodiment of the present invention.

In one embodiment of the present invention, as shown in FIG. 1, a speaker system includes a first 10, second 20, third 30 and fourth 40 sound radiators, preferably common loudspeakers mounted in speaker cabinets, as shown, with the second sound radiator 20 positioned medially between the first 10 and third 30 sound radiators, as shown. In this specification, each sound radiator may be comprised of one or more loudspeakers, or the equivalent thereof, and such plural loudspeakers may be placed and or oriented in various ways not limited to the illustrated formats, but which will not diminish the effects produced by the system as disclosed. The radiators 10, 20, 30 and 40 are able to project sound waves, as is known in the art, and such sound waves extend from each of the radiators in an outwardly traveling cone shaped dispersion pattern 50 as shown schematically in FIG. 1 with respect to radiator 10.

Such a cone shaped pattern 50 may be represented by a vector arrow, as shown in FIG. 1. The vector arrows define the center line of symmetry of the cone shaped sound radiation in the figures, and by its length, the frequency range of the sound radiation, with a longer vector arrow representing a lower frequency range, and shorter vector arrow representing a higher frequency range. Thus the length of the vector arrows schematically represent the wavelength ranges associated with the sound radiators. The vector arrows define the direction in which the sound is traveling, i.e., away from the radiators.

In FIG. 1, sound vectors are shown for the first 10, second 20, third 30 and fourth 40 sound radiators as vectors 12, 22, 32 and 42 respectively. Preferably the second sound vector 22 is pointed vertically and the first 12 and third 32 sound vectors are directed generally toward each other at angles above the horizontal, represented by plate 45. Sound vectors 12 and 32 intersect, in the embodiment of FIG. 1, above sound radiator 20 and centered on it, at an angle in the range between 90 and 170 degrees, with a preferred angle of about 120 degrees. This arrangement has shown to have the advantage of boosting the high end of the audio spectrum and providing improved sound spaciousness, and, when used in pairs, provides a true stereophonic effect over a wide listening area as well. Radiators 10 and 30 are interconnected with the related sound amplifier system (not shown) in such manner as to compliment rather than cancel each others sound, as is well known in the art. As is well known in the audio art also, the placement of a low end radiator (bass or woofer) is less significant since the low frequencies radiate in an multidirectional manner.

Thus, radiator 40 may be placed as shown or at other positions with relatively little effect on the present invention's objectives.

In the present invention, it has been found to be significant to have the sound vectors 12, 22, and 32 intersect at a common point directly above sound radiator 20. However, as shown below, alternative vector directions are advantageous.

Figure 2:
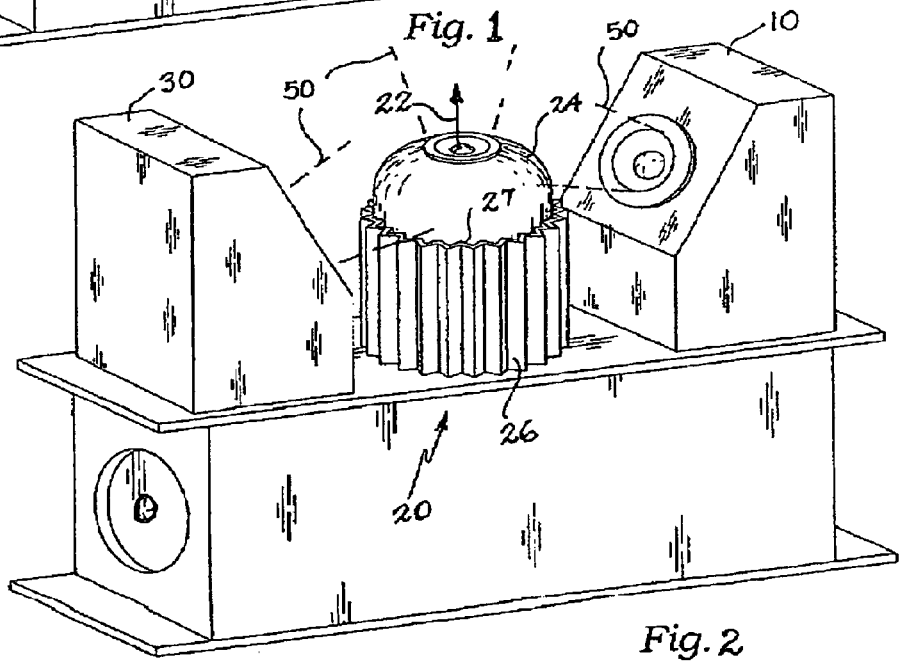
FIG. 2 is a perspective view of a further embodiment thereof.

As shown in FIG. 2, the enclosure of the second sound radiator 20 preferably presents a curved surface 24 which is symmetrical about the second vector 22, the curved surface 24 terminating upwardly within the dispersion pattern 50 of both the first 10 and third 30 sound radiators. The bounce or echo effect from this relationship provides improved apparent depth to the sound of the mid-range radiators 10 and 30 due to part of the sound vectors 12 and 32 being delayed relative to the dominant portions therefrom.

Preferably, the curved surface 24 is positioned above a vertically oriented annular pleated surface 26. A horizontal intersection 27 of the curved surface 24 and the pleated surface 26 is positioned below dispersion cones 50 of the first 10 and third 30 radiators providing the advantage of suppressing the radiation of sound that bounces one or more times between the several radiator enclosures, and this eliminates a noise effect related thereto.

Figure 3:
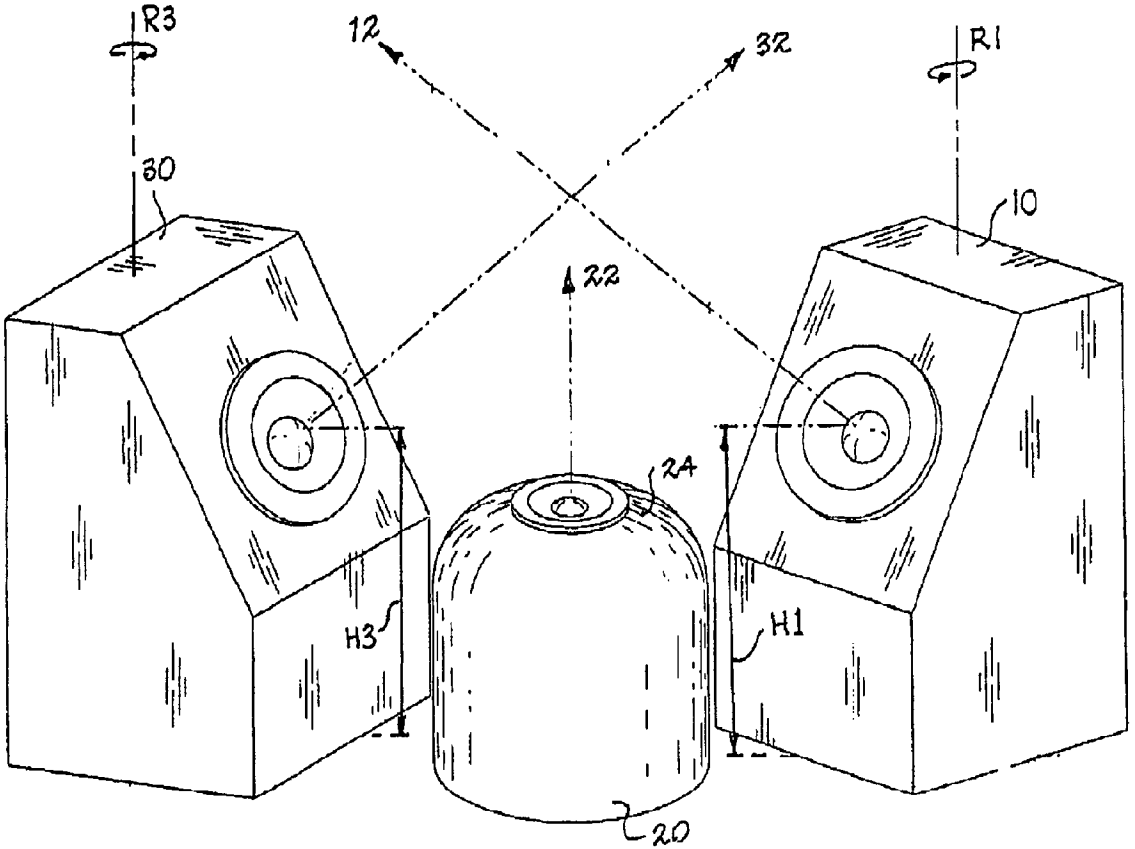
FIG. 3 is a perspective view of a still further embodiment thereof.

As shown in FIG. 3, the first 10 and third 30 radiators are displaced vertically with H1 and H3 the heights of the centers of the radiators 10 and 30 respectively, not equal. This has the advantage of improved sound spaciousness or depth effect due to a slight time delay between corresponding portions of the sound vectors 12 and 32. Further, the angles the sound vectors 12 and 32 make with the horizontal 45 are not equal, i.e., the enclosures have different sloping front surfaces, again causing time delays between corresponding portions of the sound radiated from the two sound sources, radiators 10 and 30. Preferably, the first 12 and the third 32 sound vectors form an obtuse angle of intersection when viewed in a top plan view of the system, i.e., each of the two sound sources 10 and 30 are rotated about their respective vertical axes toward the listening audience, but by different degrees of rotation R1 and R3 where R1 is not equal to R3.

Figure 4A:
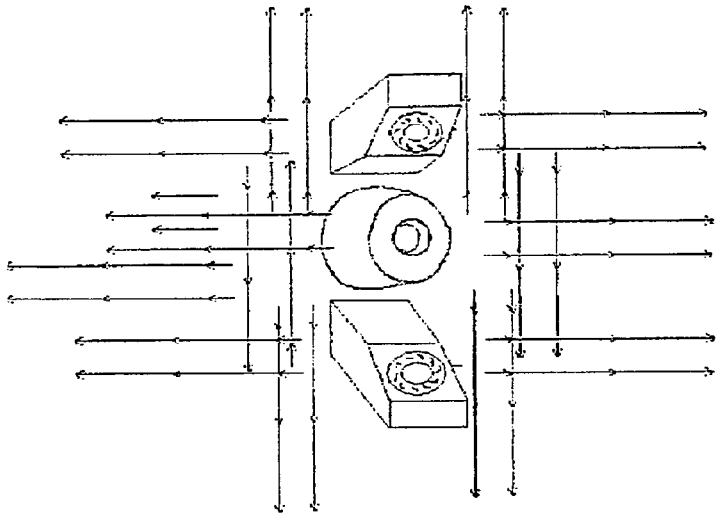
FIG. 4A and FIG. 4B are pictorial illustrations of the sound radiation produced by an embodiment in a room.
Figure 4B:
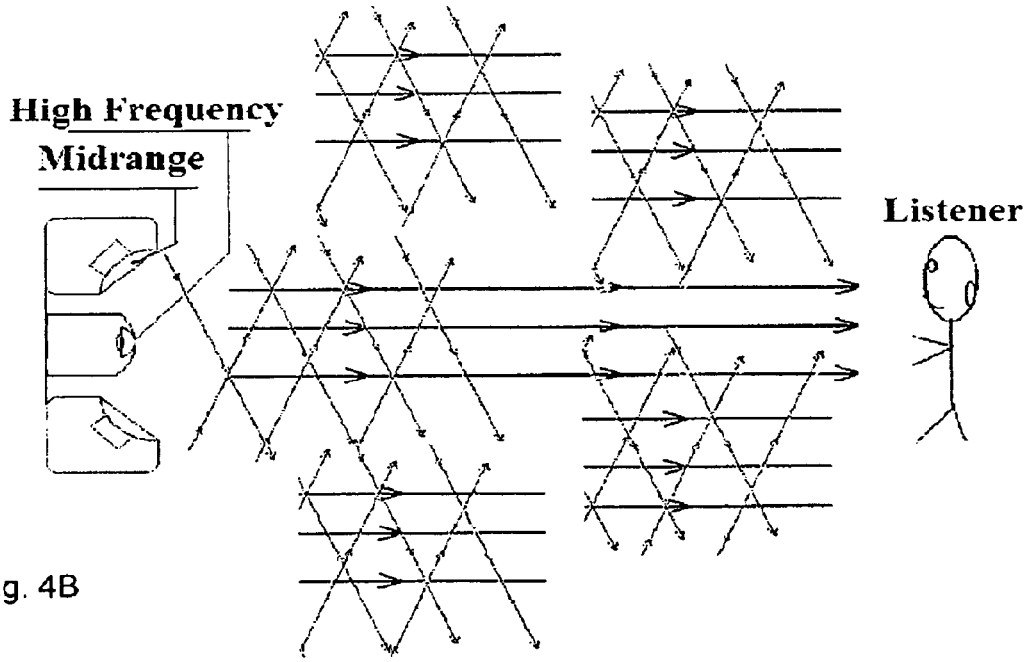

FIG. 4A and FIG. 4B are pictorial illustrations of the sound radiation produced by an embodiment in a room, wherein FIG. 4A is a front perspective view that illustrates horizontal and vertical components of the radiation emitted from the embodiment, and FIG. 4B is a side elevational view that illustrates radiation directed toward a listener in the room.

The enablements described in detail above are considered novel over the prior art of record and are considered critical to the operation of at least one aspect of one best mode embodiment of the instant invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of the embodiments of the herein described invention and its related embodiments not described are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A speaker system comprising:

first, second and third sound radiators, each sound radiator mounted in a respective enclosure; the second sound radiator radiating at high audio frequencies and positioned medially between the first and third sound radiators, only the respective enclosure of the second sound radiator having a reflective surface (reflectively dispersive shape) and having a height no greater than the height of the respective first and third radiator enclosures; the first and third sound radiators radiating at low to mid audio frequencies and tilted generally toward each other; the sound radiators projecting first, second and third sound vectors, respectively, with the second sound vector oriented vertically and the first and third sound vectors directed generally toward each other al angles above the horizontal so as to intersect at an inclusive angle of between 90 and 170 degrees; the first and third sound radiators spaced horizontally apart by at least a horizontal width of the second sound radiator, the first, second and third sound radiators providing wide dispersion of sound produced by the first and third sound radiators.

2. The system of claim 1 wherein the enclosure of the second sound radiator has an upwardly directed, semispherical surface, the semispherical surface symmetrical with respect to the second sound vector, the semispherical surface terminating upwardly above dispersion angles of the first and third sound radiators such that a portion of the sound radiated from the first and third sound radiators is reflected from the semispherical surface.

3. The system of claim 1 wherein the reflective surface is positioned above a pleated surface to further disperse the radiated sound from the first and third radiators, the pleated surface comprising a circular array of vertically oriented pleats wherein each pleat has a pair of surfaces meeting at an angle, a horizontal intersection of the reflective surface and the pleated surface positioned below dispersion angles of the pair of radiators, such that spurious portions of the sound radiated from the first and third radiators is diffused by the pleated surface.

4. A speaker system comprising; first, second and third sound radiators, the sound radiators mounted in respective first, second and third mutually spaced apart sound enclosures; the second sound enclosure positioned medially between the first and third sound enclosures, the first, second and third sound radiators projecting first, second and third sound vectors, respectively, with the second sound vector oriented vertically and the first and third sound vectors directed generally toward each other at angles above the horizontal; only the second sound enclosure having an upwardly facing semispherical convex reflective surface terminating upwardly above dispersion angles of the first and third sound radiators such that a portion of sound radiated from each of the first and third sound radiators is reflected from the reflective surface; the second sound vector directed away from the reflective surface.

* * * * *